US009156083B2

(12) United States Patent
Castellani

(10) Patent No.: US 9,156,083 B2
(45) Date of Patent: Oct. 13, 2015

(54) ENERGY-SAVING STEEL PRODUCTION APPARATUS AND METHOD THEREOF

(75) Inventor: Federico Castellani, Tarcento (IT)

(73) Assignee: SMS MEER S.P.A., Tarcento (UD) (IT)

( * ) Notice: Subject to any disclaimer, the term of this patent is extended or adjusted under 35 U.S.C. 154(b) by 0 days.

(21) Appl. No.: 14/003,736

(22) PCT Filed: Mar. 19, 2012

(86) PCT No.: PCT/IT2012/000075

§ 371 (c)(1),
(2), (4) Date: Nov. 18, 2013

(87) PCT Pub. No.: WO2012/131736

PCT Pub. Date: Oct. 4, 2012

(65) Prior Publication Data

US 2014/0054002 A1 Feb. 27, 2014

(30) Foreign Application Priority Data

Apr. 1, 2011 (IT) ..... VI2011A0074

(51) Int. Cl.

| | |
|---|---|
| ***B22D 11/14*** | (2006.01) |
| ***B22D 47/00*** | (2006.01) |
| ***B21B 1/46*** | (2006.01) |
| ***B22D 11/128*** | (2006.01) |
| ***B21B 13/22*** | (2006.01) |
| ***B22D 11/12*** | (2006.01) |

(52) U.S. Cl.

CPC ..... *B22D 11/1287* (2013.01); *B21B 1/46* (2013.01); *B21B 13/22* (2013.01); *B22D 11/1206* (2013.01); *B22D 11/14* (2013.01); *B22D 47/00* (2013.01); *B21B 1/466* (2013.01)

(58) Field of Classification Search

CPC ..... B22D 11/1206; B22D 11/14; B22D 11/1287; B22D 47/00; B21B 1/46466; B21B 13/22

USPC ..... 164/493, 507, 459, 418, 419, 441, 442

See application file for complete search history.

(56) References Cited

U.S. PATENT DOCUMENTS

| | | | | |
|---|---|---|---|---|
| 6,092,586 | A * | 7/2000 | Schonbeck | 164/476 |
| 2009/0056906 | A1 * | 3/2009 | Arvedi | 164/471 |

FOREIGN PATENT DOCUMENTS

| | | | |
|---|---|---|---|
| CN | 1135941 | A | 11/1996 |
| CN | 101293257 | A | 10/2008 |
| CN | 101658860 | A | 3/2010 |
| DE | 19639298 | A1 | 3/1998 |
| EP | 0761328 | A1 | 3/1997 |
| JP | 57-121806 | A | 7/1982 |
| WO | 2009/036665 | A1 | 3/2009 |

OTHER PUBLICATIONS

Search Report of Italian Patent Office dated Dec. 12, 2011.
Office Action from Chinese Patent Office dated Nov. 14, 2014.

* cited by examiner

*Primary Examiner* — Kevin P Kerns
*Assistant Examiner* — Steven Ha
(74) *Attorney, Agent, or Firm* — Hedman & Costigan, P.C.; James V. Costigan; Kathleen A. Costigan

(57) ABSTRACT

The present invention relates to a energy-saving steel production apparatus, including an hot-rolling production line and a continuous casting equipment (5) for producing semi-manufactured products or billets (10), said production line and said equipment facing one each other and being connected through fast transport means (7) moving said billets (10). The invention also relates to a method for processing energy-saving steel, comprising the following steps:

a. taking the steel to a casting temperature;
b. casting said steel in suitable moulds for obtaining a semi-manufactured product (10);
c. transferring directly said casted semi-manufactured product (10) towards a rolling mill through fast transport means;
d. taking said semi-manufactured product (10) to a value of temperature corresponding to a maximum value of plasticity;
e. subjecting said semi-manufactured product (10) to a rolling process.

1 Claim, 1 Drawing Sheet

ENERGY-SAVING STEEL PRODUCTION APPARATUS AND METHOD THEREOF

The present invention relates to a high energy-saving steel production apparatus and to a method thereof, in particular an apparatus for rolling steel sections or bars.

More in detail, the invention relates to an apparatus providing a rolling process for making steel laminates, such as steel profiles or bars, which allows to reduce the consumption of heat energy used to reach different temperatures, as well as to reduce emissions of some pollutants.

Rolling plants such as the plant shown in FIG. 1B and indicated with the reference B are currently known.

The rolling mill process, which is performed during the production of steel, is the process by which the mechanical characteristics and a desired shape of the metal are obtained; said process is performed by passing the material to be rolled, indicated with 10, in a mould having a section greater than the section of the finished product and between a pair of smoothed or grooved rolls 4.

The distance between the two rolls 4 is smaller than the thickness of the inlet material 10.

The starting material is generally a so-called "billet", obtained by the solidification of the steel in special continuous casting plants, as shown in FIG. 1A and indicated with the reference A.

The steel, after being cast, along an area of continuous casting 5, in the moulds, passes into a cooling zone 6 in which it solidifies in the form of a billet 10.

Before subjecting the billet 10 to the rolling process, it is necessary to heat it in a setting train 2, bringing it to a temperature corresponding to a maximum of plasticity, that is to say between 1000° C. and 1150° C. for the steel.

The heating is performed by means of a flame furnace 2A, which usually is fed with heavy oil or gas.

The entire process of steel production, therefore, requires two stages of heating of the material: a first stage, in which it has to reach a liquid phase, and the second stage, next to a cooling, through which a plastic phase is obtained.

Consequently, the process involves a considerable energy consumption.

Much of said energy is dissipated, in the form of heat, during the cooling process of the semi-finished products or billets or of the finished product of the rolling process.

Therefore, there is still the need to have an apparatus for processing steel capable of ensuring high energy savings during the steel processing, with respect to the apparatus that are currently used.

In particular, it is clear that there is a need to provide a method for processing steel which allows to optimize the amount of heat used to bring the steel at values of temperature necessary to the subsequent processing steps.

In addition, a second drawback of a known rolling plant is constituted by the fact that said rolling plant is not very efficient in production and space management.

In fact, in order to heat and then cool the wires of steel to be rolled, it is necessary to have space for the cooling and then for the subsequent heating.

It is clear from the foregoing that it is necessary to have an apparatus for rolling steel that involves a high production efficiency.

Again, the use of flame furnaces results in the emission of harmful substances, such as CO2, SO2 and NOx.

Therefore, an object of the present invention is to overcome the drawbacks of the prior art by providing an apparatus for processing steel which involves higher production efficiency with respect to the known rolling plants.

In particular, object of the present invention is to provide an apparatus for processing steel with high energy savings.

Within this object, an aim of the present invention is to provide an apparatus for processing steel which allows to reduce the overall dimensions of the plant.

Another aim of the present invention is to provide an apparatus for processing steel that avoids consumption of electrical energy and therefore reduces production costs.

A further object of the invention is to provide a method for processing steel which provides a production rate greater than the rate obtained with the known methods.

These and other objects are achieved by an apparatus for processing steel as claimed in the alleged claim 1 and by means of a method thereof according to the alleged claim 3.

Further detailed technical characteristics of the apparatus and method according to the invention are indicated in the dependent claims.

Advantageously, the integration between steel mill and rolling mill through a direct hot charge leads to considerable energy savings by also reducing the production costs to more than 300 kWh/t.

Another advantage provided by the present invention is to make the steel production more sustainable from the point of view of environmental pollution.

In particular and advantageously, the heating flame furnace is not used and therefore, in addition to fuel savings, it is possible to reduce pollutants emissions, such as CO2, SO2 or NOx.

For example, if we consider a plant of 800,000 t/y EES, there is a reduction of 72,000 t/y in CO2 emissions, a reduction of 410 t/y in SO2 emissions and a reduction of 225 t/y in Nox emissions.

The present invention thus allows to make the steel production ever more environmentally friendly.

The above mentioned objects and advantages of the invention will appear to a greater extent from the following description, relating to a preferred embodiment of the apparatus for steel rolling, according to the invention, and from the enclosed drawings, in which.

Figure 1B:
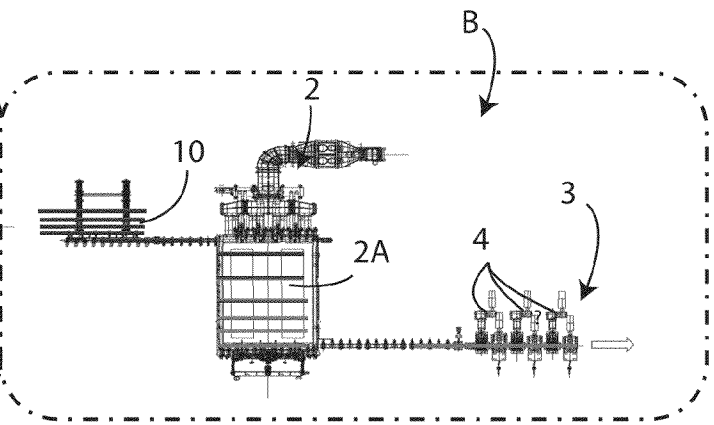
FIG. 1B is a diagram of a second part of the apparatus for rolling steel bars according to the prior art.
Figure 1A:
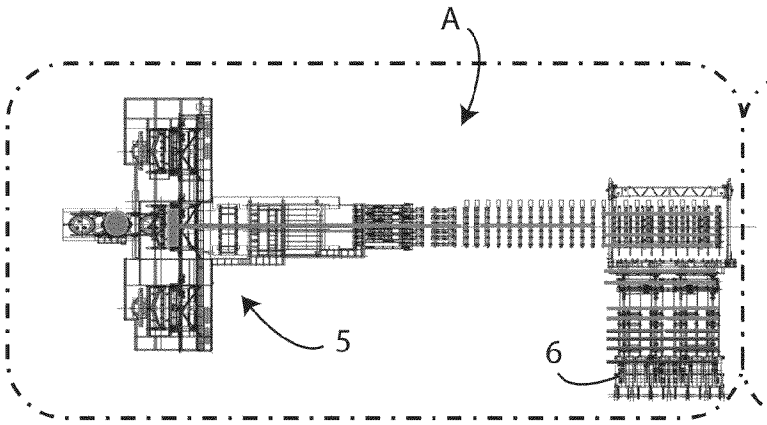
FIG. 1A is a diagram of a first part of an apparatus for rolling steel bars according to the prior art.
Figure 2:
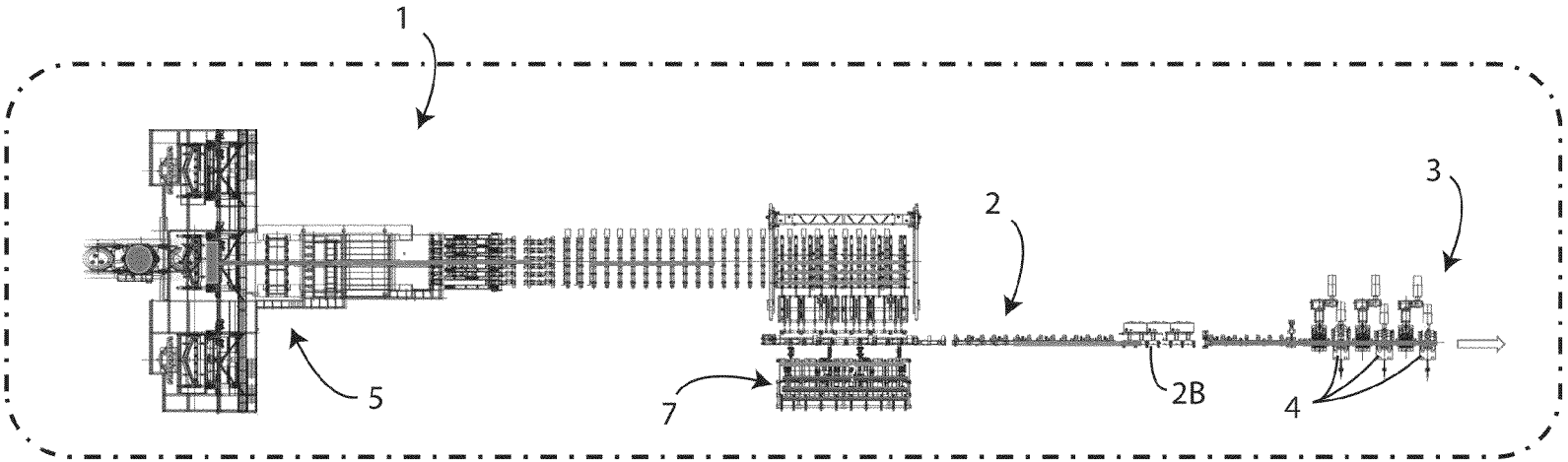
FIG. 2 is a diagram of the apparatus for rolling steel bars according to the present invention.

Referring particularly to FIG. 2, the rolling apparatus according to the invention, indicated with 1, includes a setting train 2 facing a finishing train 3, which comprises a plurality of cages 4.

The layout of the apparatus provides a direct connection from the continuous casting plant 5 to the setting train 2 of the rolling mill, by means of fast transport means 7 of the billets 10, which are totally solidified and which have an average temperature ranging from 850° C. to 900° C.

Since the rolling temperature suitable for a proper plasticity of the material must be greater than 1000° C., it is necessary to bring the billets 10 to said rolling temperature.

Therefore, the setting train 2 provides an induction-type tunnel furnace 2B.

Thus, the temperature needed for rolling is quickly reached and it is possible to proceed with the processing of the billets by means of the pairs of rolls 4 of the finishing train 3, with an energy consumption which is greatly reduced with respect to the prior art.

Advantageously, the apparatus for processing steel according to the present invention allows to reduce the overall dimensions with respect to the known plants, thus avoiding the space needed for cooling the billets and for their storage.

The method for processing steel according to the present invention provides the following steps:

a. taking the steel to a melting temperature greater than 1500° C.;

b. casting the steel into moulds, thus obtaining a semi-finished product;

c. transferring the semi-finished casted product to a rolling mill by means of fast transport means;

d. taking the semi-finished product to a temperature of maximum plasticity (greater than 1000° C.);

e. subjecting the semi-finished product to a rolling process.

In particular, step c. allows a reduction of the steel temperature to around 800-900° C., thus also allowing a complete solidification of the material, that acquires the mechanical properties required for the finished products to be placed on the market.

More in detail, step d. takes place preferably using induction-type furnaces, which limit the emissions of the above mentioned pollutants.

Even more in detail, the rolling process mentioned in step e. can take place by using preferably a known rolling mill plant.

The features, as well as the advantages, of the high production rolling apparatus, in particular for rolling steel bars and sections, which is the object of the present invention, are clear from the above description.

Finally, although the invention has been described for illustrative but not imitative purposes, according to a preferred embodiment, it is to be understood that variations and/or modifications can be made by those skilled in the art, without departing from the scope of protection as set forth in the appended claims.

The invention claimed is:

1. An energy saving method for processing steel, consisting of the following steps:

(a). taking the steel to a casting temperature higher than 1500° C.;

(b). casting said steel in suitable molds to obtain a casted semi-manufactured solidified billet (10);

(c). transferring said casted semi-manufactured solidified billet (10) that is at an average temperature of 850-900° C., that allows for complete solidification of said semi-manufactured solidified billet (10) to a rolling mill;

(d). taking said semi-manufactured solidified billet (10) to a temperature corresponding to a maximum value of plasticity where said temperature corresponding to a maximum value of plasticity is between 1000° C. and 1150° C.;

(e). subjecting said semi-manufactured solidified billet (10) to a rolling process characterized in that said step (d) occurs by means of intermediate rolls (2) provided with an induction-type tunnel furnaces.

* * * * *